US009784142B2

(12) United States Patent
Grimm et al.

(10) Patent No.: US 9,784,142 B2
(45) Date of Patent: Oct. 10, 2017

(54) SPRING ARRANGEMENT FOR A VARIABLE VALVE DRIVE OF AN INTERNAL COMBUSTION ENGINE

(71) Applicant: PIERBURG GMBH, Neuss (DE)

(72) Inventors: Karsten Grimm, Aachen (DE); Martin Nowak, Leverkusen (DE); Christoph Sadowski, Sprockhoevel (DE); Sabine Siebrandt, Viersen (DE)

(73) Assignee: PIERBURG GMBH, Neuss (DE)

( * ) Notice: Subject to any disclaimer, the term of this patent is extended or adjusted under 35 U.S.C. 154(b) by 15 days.

(21) Appl. No.: 14/899,560

(22) PCT Filed: Apr. 4, 2014

(86) PCT No.: PCT/EP2014/056799
§ 371 (c)(1),
(2) Date: Dec. 18, 2015

(87) PCT Pub. No.: WO2014/206591
PCT Pub. Date: Dec. 31, 2014

(65) Prior Publication Data

US 2016/0146066 A1 May 26, 2016

(30) Foreign Application Priority Data

Jun. 25, 2013 (DE) ..... 10 2013 106 646

(51) Int. Cl.
*F01L 1/344* (2006.01)
*F01L 13/00* (2006.01)
(Continued)

(52) U.S. Cl.
CPC ..... *F01L 1/344* (2013.01); *F01L 1/14* (2013.01); *F01L 13/0021* (2013.01);
(Continued)

(58) Field of Classification Search
CPC ..... F01L 13/0021; F01L 13/0063; F01L 2013/0068; F01L 1/14; F01L 1/185; F01L 1/344; F01L 2105/00
(Continued)

(56) References Cited

U.S. PATENT DOCUMENTS 6,868,811 B2 * 3/2005 Koro ..... F01L 1/044 123/90.15
7,188,595 B2 * 3/2007 Hara ..... F01L 1/18 123/90.16
2013/0220251 A1 8/2013 Flierl

FOREIGN PATENT DOCUMENTS

DE 10 2004 003 327 A1 9/2005
DE 10 2004 049 538 A1 4/2006
(Continued)

*Primary Examiner* — Loren Edwards
(74) *Attorney, Agent, or Firm* — Norman B. Thot

(57) ABSTRACT

A spring arrangement for a variable valve drive of an internal combustion engine includes an intermediate lever, a control shaft, a control shaft roller, a working cam contour, and a spring element. The intermediate lever comprises a contact surface, a camshaft roller which bears against a camshaft, and a slot roller which bears against a slotted guide. The control shaft roller is arranged on the intermediate lever to face away from the slotted guide. The control shaft roller bears against the control shaft. The working cam contour is formed at an end of the intermediate lever opposite the camshaft roller. The spring element comprises a force component on the contact surface in the direction of the camshaft and the slotted guide, and an end leg. The spring element loads the camshaft roller against the camshaft and the slot roller against the slotted guide. The end leg bears against the contact surface.

8 Claims, 2 Drawing Sheets

(51) Int. Cl.
*F01L 1/14* (2006.01)
*F01L 1/18* (2006.01)

(52) U.S. Cl.
CPC ..... *F01L 13/0063* (2013.01); *F01L 1/185* (2013.01); *F01L 2013/0068* (2013.01); *F01L 2105/00* (2013.01)

(58) Field of Classification Search
USPC ..... 123/90.15, 90.16
See application file for complete search history.

(56) References Cited

FOREIGN PATENT DOCUMENTS

| | | | |
|---|---|---|---|
| DE | 10 2004 058 106 | A1 | 6/2006 |
| DE | 10 2005 040 959 | A1 | 3/2007 |
| DE | 10 2007 047 582 | A1 | 4/2009 |
| DE | 10 2010 009 399 | A1 | 9/2011 |
| DE | 10 2010 048 708 | A1 | 4/2012 |
| DE | 10 2012 002 026 | A1 | 8/2013 |
| EP | 1 387 050 | A1 | 2/2004 |
| JP | 2004-52604 | A | 2/2004 |
| WO | WO 2009/043331 | A1 | 4/2009 |

* cited by examiner

SPRING ARRANGEMENT FOR A VARIABLE VALVE DRIVE OF AN INTERNAL COMBUSTION ENGINE

CROSS REFERENCE TO PRIOR APPLICATIONS

This application is a U.S. National Phase application under 35 U.S.C. §371 of International Application No. PCT/EP2014/056799, filed on Apr. 4, 2014 and which claims benefit to German Patent Application No. 10 2013 106 646.1, filed on Jun. 25, 2013. The International Application was published in German on Dec. 31, 2014 as WO 2014/206591 A1 under PCT Article 21(2).

FIELD

The present invention relates to a spring arrangement for a variable valve drive of an internal combustion engine having an intermediate lever, at least one camshaft roller on the intermediate lever, which camshaft roller bears against a camshaft, a slot roller on the intermediate lever, which slot roller bears against a slotted guide, at least one control shaft roller on the intermediate lever, which control shaft roller bears against a control shaft and is arranged on that side of the camshaft roller which faces away from the slotted guide, at least one working cam contour which is formed at the end of the intermediate lever which lies opposite the camshaft roller and acts on a roller drag lever of a gas exchange valve, and at least one spring element, via which the camshaft roller of the intermediate lever is loaded against the camshaft and the slot roller is loaded against the slotted guide.

BACKGROUND

Variable valve drives have become known in various embodiments in recent years as a means for reducing fuel consumption and emissions. With such variable valve drives, the roller drag lever of the gas exchange valves is no longer actuated directly by the camshaft, but via a working cam contour of an intermediate lever. When the camshaft rotates, this intermediate lever is guided on a contour by a first roller so that a tilting movement of the intermediate lever causes a movement of the working curve contour on the roller of the roller drag lever. The manner in which the working curve acts on this roller drag lever is, however, dependent on the position of a rotatable control shaft that acts on a second roller of the intermediate lever. By changing the position of the control shaft, a varied tilting movement of the working curve contour and thus a varied opening and closing movement of the gas exchange valve are caused.

In order to perform this function with sufficient precision, it is therefore necessary to press the rollers of the intermediate lever both against the slotted guide and against the camshaft and the control shaft for all positions of the camshaft, the slotted guide, and the control shaft. Spring elements are used therefor that are most often double-leg springs with two oppositely wound helixes, the two spring end legs thereof respectively being prestressed to bear on one of the drag levers, while the intermediate leg is fixed, for example, to the component forming slotted guide.

DE 10 2007 047 582 A1 describes a means for controlling the residual gas content of cylinders in an internal combustion engine, wherein a double-leg spring is fastened above the slotted guide path by its intermediate leg, and the helixes of the spring are also arranged above the component supporting the slotted guide. The spring end legs engage the axis of the camshaft rollers and load the camshaft rollers against the camshaft and the slotted guide. In order to additionally provide that the control shaft roller rests on the contact shaft, a secondary spring is fastened at the slotted guide component, the end legs being prestressed to bear against the intermediate lever at the level of the axis of the control shaft roller and to thereby press the roller against the control shaft.

This structure has the disadvantage, however, that two different spring elements must be used to generate sufficient pressing forces. DE 10 2010 048 708 A1 therefore describes a spring arrangement in which only one spring element is used to load the camshaft roller against the slotted guide and the camshaft and to tension the control shaft roller against the control shaft. For this purpose, a spring element is arranged so that it engages the intermediate lever in the region of the working cam and exerts a force in the direction of the contour as well as a force perpendicular thereto. A torque is thereby generated about a fulcrum between the two rollers which causes the control shaft roller to be loaded in one direction toward the control shaft, and the camshaft roller to be loaded in the opposite direction towards the camshaft. A problem with this structure is, however, that a direct pressing force is exerted on the control shaft which, in such a valve drive, is already subjected to high loads and increased wear.

SUMMARY

An aspect of the present invention is to provide a spring arrangement for a variable valve drive of an internal combustion engine which provides the necessary contact forces of the contact points of the intermediate lever without excessive transverse forces acting on the control shaft. An additional aspect of the present invention is to reduce the assembly effort and structural space requirements.

In an embodiment, the present invention provides a spring arrangement for a variable valve drive of an internal combustion engine which includes an intermediate lever, a control shaft, at least one control shaft roller, at least one working cam contour, and at least one spring element. The intermediate lever comprises a contact surface, at least one camshaft roller, and a slot roller. The at least one camshaft roller is configured to bear against a camshaft. The slot roller is configured to bear against a slotted guide. The at least one control shaft roller is arranged on a side of the intermediate lever which faces away from the slotted guide. The at least one control shaft roller is configured to bear against the control shaft. The at least one working cam contour is formed at an end of the intermediate lever which lies opposite the camshaft roller. The at least one working cam contour is configured to act on a roller drag lever of a gas exchange valve. The at least one spring element comprises a force component on the contact surface in the direction of the camshaft and in the direction of the slotted guide, and an end leg. The at least one spring element is configured to load the at least one camshaft roller of the intermediate lever against the camshaft and the slot roller against the slotted guide. The end leg is configured to bear in a prestressed manner against the contact surface on a side of the intermediate lever which faces away from the at least one working cam contour and the camshaft.

BRIEF DESCRIPTION OF THE DRAWINGS

The present invention is described in greater detail below on the basis of embodiments and of the drawings in which.

DETAILED DESCRIPTION

Figure 1:
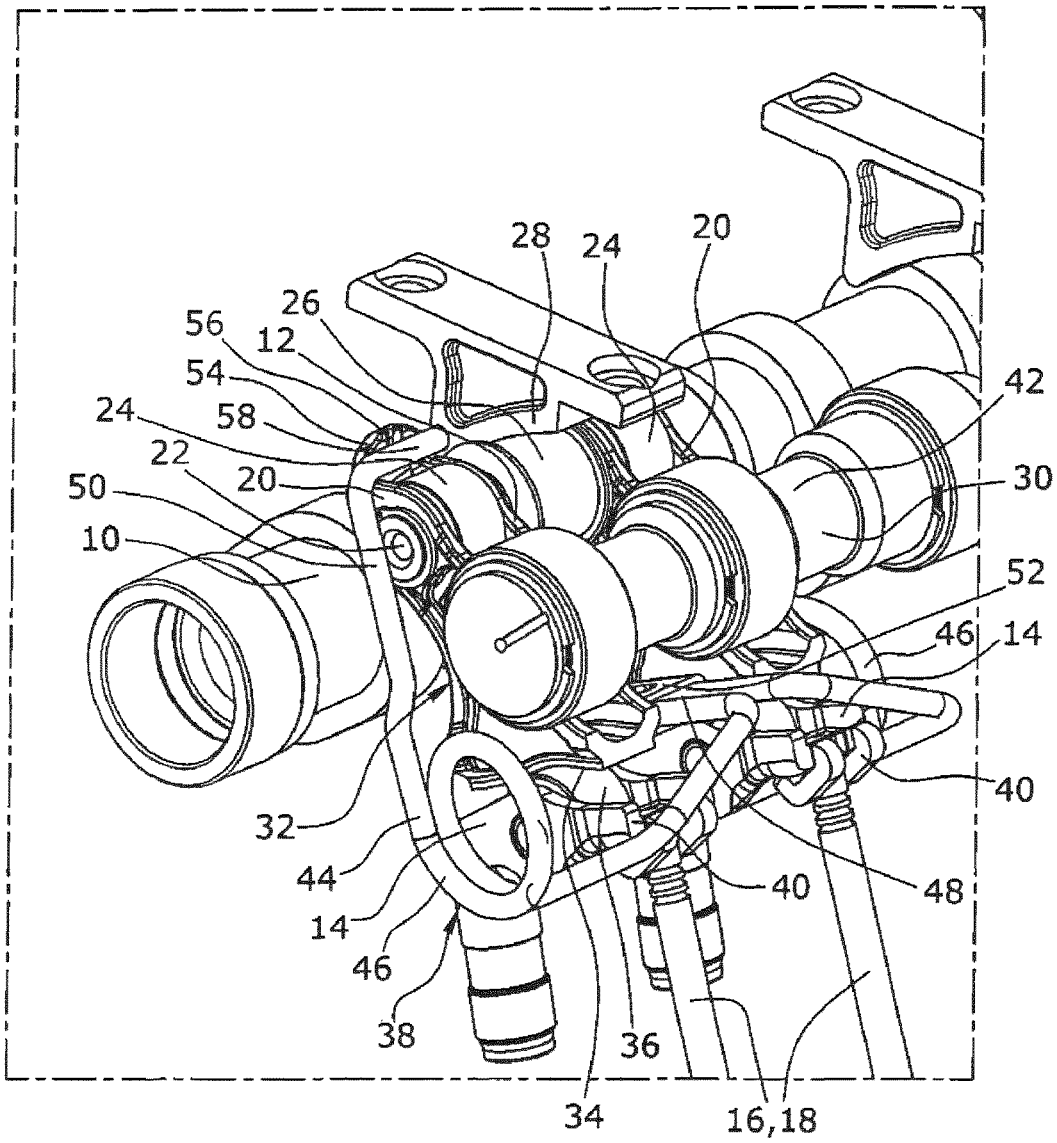
FIG. 1 illustrates a detail of a first embodiment of a spring arrangement for a variable valve drive in perspective view, the engine housing parts not being shown for better understanding.

A secure contact of the intermediate layer on the camshaft and the slotted guide is obtained due to the fact that an end leg of the spring element is prestressed to bear against a contact surface of the intermediate lever on the side of the intermediate lever averted from the working cam structure and the camshaft, and that, at the contact surface, the spring element has a force component in the direction of the cam shaft and in the direction of the slotted guide. The bearing play and tolerances of the intermediate lever are compensated and the forces acting on the shafts are distributed in a particularly advantageous manner.

In an embodiment of the present invention, the contact surface can, for example, be arranged on the intermediate lever on that side of an axis of rotation of the camshaft roller that is opposite the working cam contour so that the spring element generates a torque about the axis of rotation of the camshaft roller of the intermediate lever. Due to this torque, the intermediate lever also achieves a secure contact with respect to the camshaft, yet without the latter being subjected to an excessive pressing force. A sufficient contact force is accordingly generated for all contact points of the intermediate lever via a single spring element.

In an embodiment of the present invention, the spring element can, for example, be provided as a double-leg spring whose intermediate leg is fastened to the bearing housing of the variable valve drive and whose end legs are each prestressed to bear against a respective protrusion of two mutually adjacent intermediate lever members of the intermediate lever, the protrusion forming the contact surface. Both intermediate lever members of two adjacent gas exchange valves are thus loaded in the direction of the three contact points by a single spring element, wherein the slot roller is advantageously arranged between the two intermediate lever members.

In an embodiment of the present invention, the helix of the spring element can, for example, be arranged on the side of the intermediate lever averted from the camshaft and the roller drag lever. In this embodiment, due to the excellent accessibility, the spring element is simple to assemble and, if necessary, to replace.

In an embodiment of the present invention, the helix of the spring element can, for example, be arranged on the side of the camshaft directed to the roller drag lever. The structural space necessary is thereby reduced.

In an embodiment of the present invention, the helix can, for example, be arranged in the region of an axial projection of an axis of rotation of a roller of the roller drag lever. With such a positioning of the spring element, the desired forces and torques can be induced in a suitable manner and the spring element can be integrated into the variable valve drive in a compact manner.

In an embodiment of the present invention, the two adjacent roller rag levers assigned to a double-leg spring can, for example, be arranged between the two helixes of the double-leg spring so that a good accessibility of the spring element is retained.

In an embodiment of the spring element of the present invention, the two helixes of the double-leg spring can, for example, be arranged between the two adjacent roller drag levers assigned to a double-leg spring. The spring leg lengths can thereby be shortened.

A spring arrangement for a variable valve drive of an internal combustion engine is thus provided with which, using only a single spring element, the required contact forces can be obtained in all three contact points and, in addition, no excessive forces are exerted on bearings or rollers. The intermediate lever is reliably positioned, its bearing plays are compensated, and tolerance compensation is provided. The assembly effort is at the same time low, and the required structural space is small.

Two embodiments of the present spring arrangements for a variable valve drive of an internal combustion engine are illustrated in the drawings and will be described below.

Figure 2:
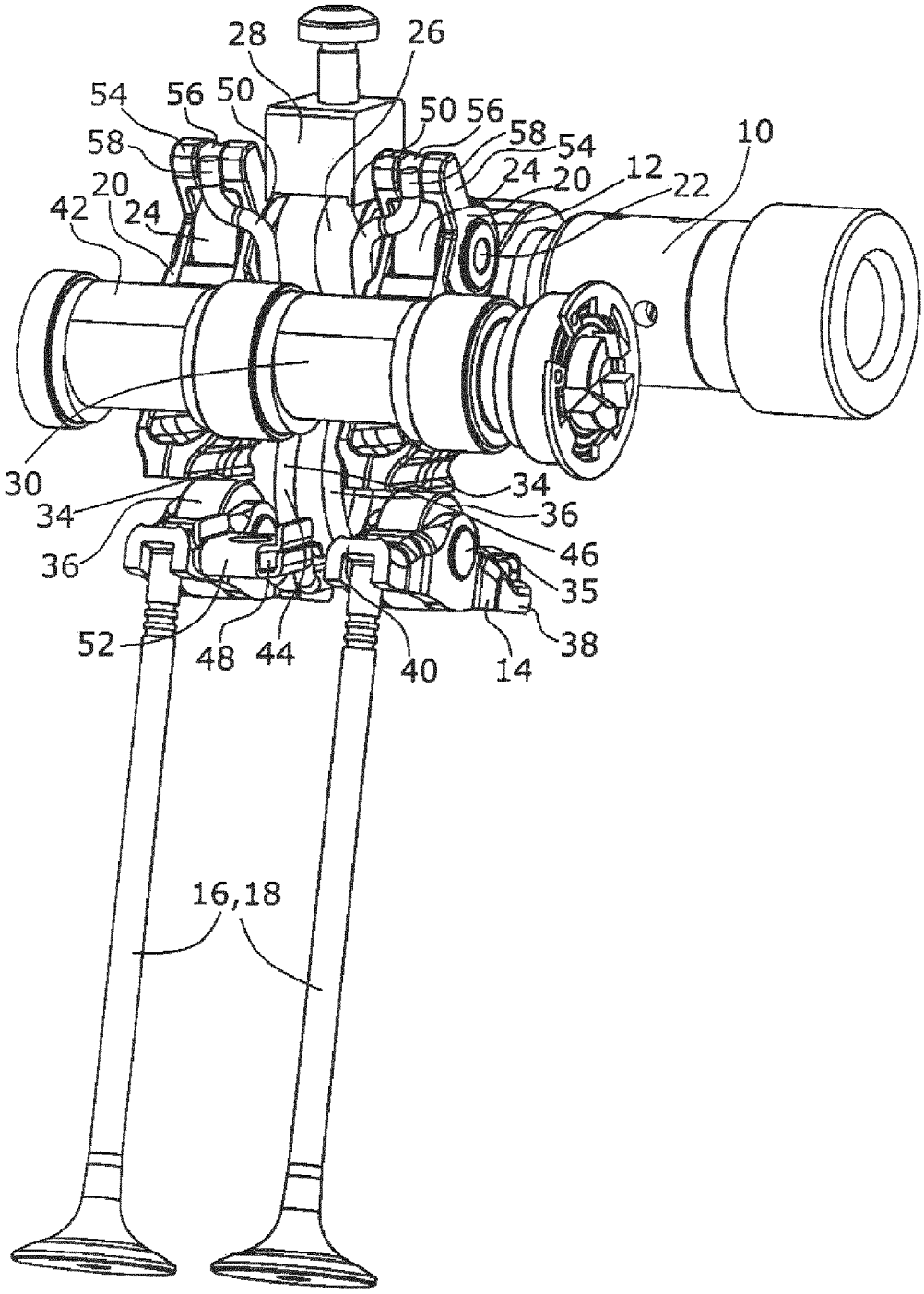
FIG. 2 illustrates a detail of a second embodiment of a spring arrangement for a variable valve drive in perspective view, the engine housing parts not being shown for better understanding.

The variable valve drive illustrated in FIGS. 1 and 2 consists of a camshaft 10 in operative connection with a roller drag lever 14 via an intermediate lever 12, the roller drag lever in turn being connected with a valve rod 16 of a gas exchange valve 18 designed as an inlet valve.

The embodiment illustrated is an internal combustion engine with two inlet valves per cylinder, each having a roller drag lever 14 assigned thereto.

In order to be able to transmit the actuation force of the camshaft 10 to the gas exchange valve 18, the intermediate lever 12 must be positioned and guided. The intermediate lever 12 must have three contact points for a fully defined, guided, tilting movement that actuates a gas exchange valve 18. A total of five contact points exists in the present embodiment since two gas exchange valves 18 are to be actuated via the single intermediate lever 12 which, for this purpose, comprises two intermediate lever members 20 that are connected by a common axis of rotation 22 on which a respective camshaft roller 24 is arranged inside the two intermediate lever members 20 and on which a slot roller 26 is arranged between the two intermediate lever members 20, the slot roller 26 bearing against a slotted guide 28 fastened to the bearing housing (which is not illustrated herein). The other two contact points exist between a control shaft 30 and two control shaft rollers 32, each of which is arranged inside a respective intermediate lever member 20.

The two control shaft rollers 32 are supported in the intermediate lever members 20 and are respectively situated between the camshaft roller 24 of the respective intermediate lever member 20 and a working cam contour 34 formed at the end of the intermediate lever member 20 that is opposite the camshaft roller 24, the working cam contour 34 bearing against a drag lever roller 36 of the roller drag lever 14.

When the camshaft 10 rotates, a tilting movement of the intermediate lever 12 is generated, the camshaft roller 24 rolls on the camshaft 10, the control shaft roller 32 rolls on the control shaft 30, and the slot roller 26 rolls on the slotted guide 28. Due to the tilting movement, the working cam contour 34 slides along the drag lever roller 36, whereby the movable end 40 of the roller drag lever 14, which is opposite the fixed supported end 38 and against which the valve rod 16 is loaded, is lowered and is lifted again during further rotation.

By rotating the control shaft 30, on which eccentric control surfaces 42 are formed that bear on the control shaft rollers 32, the section of the working curve contour 34 that engages the drag lever roller 36 is changed since the intermediate lever 12 is tilted into a different initial position.

Different opening and closing characteristics of the gas exchange valves 18 can thereby be achieved.

A correct functioning of this valve drive requires that a constant firm contact with a sufficient, yet not excessive, pressing force be provided between the camshaft 10 and the camshaft roller 24, the control shaft 30 and the control shaft roller 32, as well as the slotted guide 28 and the slot roller 26 in every operational state, i.e., in all cam positions of the control shaft 30 and the camshaft 10.

The present invention thereby provides the use of a spring element 44 in the form of a double-leg spring. The double-leg spring has two oppositely wound helixes 46 which are connected via an intermediate leg 48 with a U-shaped reverse bend. The spring element 44 has end legs 50 at the respective other end of the helixes 46.

According to the present invention, this spring element 44 is arranged and designed so that its intermediate leg 48 is fastened in an intermediate leg holder 52 fixedly mounted on the bearing housing and arranged between the two intermediate lever members 20, the slotted guide 28, and the roller drag levers 14. From there, the wires of the spring element extend in opposite axial directions up to the respective side of the roller drag levers 14 that is opposite the intermediate leg holder 52. The respective helix 46 of the spring element 44 is formed outside the intermediate lever 12 approximately in projection of the axis 35 of the drag lever rollers 36. The end legs 50 of the spring element 44 respectively extend from the helixes 46 approximately in the direction of extension of the intermediate lever members 20 and up to the end of the intermediate lever members 20 beyond the axis of rotation 22 of the camshaft rollers 24, where a respective projection 54 is formed which has a contact surface 56 against which a bent end 58 of the end leg 50 bears under prestress towards the camshaft 10.

Due to the prestress of the spring element 44, the intermediate lever 12 or the camshaft roller 24, respectively, is pressed against the camshaft 10 and the slot roller 26 is pressed into the slotted guide 28. The projection 54 must accordingly be arranged on the intermediate lever 12 so that a component of the spring force is directed towards the slotted guide 28. However, besides this pressing force exerted by the spring element 44, a torque is also generated about the axis of rotation 22 of the camshaft roller 24 or the intermediate lever 12, respectively, which causes the control shaft roller 32 to be pressed against the control shaft 30.

The spring element 44 correspondingly provides a defined position of the intermediate lever 12 via the three or five contact points on the intermediate lever 12. The control shaft roller 32 and the control shaft 30, respectively, which are anyway stressed by great forces during operation, are therefore not subjected to excessive forces as would be the case if the force were induced from the opposite side of the intermediate lever 12.

An embodiment having substantially the same effect is illustrated in FIG. 2 where similar components are identified by the same reference numerals. The only important difference between the two embodiments is the arrangement of the spring element 44.

Compared with the first embodiment, spring element 44 of FIG. 2 has two helixes 46 that are situated immediately axially adjacent to each other so that the axis of the helixes 46, as well as the intermediate leg 48, is arranged between the slotted guide 28, the camshaft 10, the two intermediate lever members 20, and the roller drag levers 14, and is situated on the side of the intermediate lever 12 opposite the control shaft 30.

Between the two intermediate lever members 20, the end legs 50 are directed past the same and engage under prestress behind a projection 54 that is formed on the side of the respective intermediate lever member 20 that is opposite the camshaft 10 and substantially also opposite the working cam contour 34. This projection 54 is also arranged so that the force vector generated has a component directed towards the camshaft 10 and a component directed towards the slotted guide 28. A torque is thereby generated about the axis of rotation 22, by which a pressing force between the control shaft roller 32 and the control shaft 30 is generated.

This spring element 44 may be somewhat more complicated to mount, however, it requires less structural space. A secure contact of the intermediate lever is provided at the required contact points via only one spring element 44 in both embodiments. The pressing forces are distributed so that no overload of the rollers or bearings must be feared. The assembly effort and the required structural space are minimized.

It should be clear that additional and different embodiments of the spring arrangement of the present invention are possible from the versions described above. For example, the two helixes may also be arranged above the slotted guide on the side opposite the camshaft and engage behind the corresponding protrusion in order to generate both the pressing force against the camshaft and the slotted guide and the torque about the camshaft roller axis, by which the control shaft roller is loaded against the control shaft. The spring arrangement also may be suitable for variable valve drives or engines of different structures so that, for example, a different number of inlet valves per cylinder is required. Modified arrangements are also conceivable within the range of protection recited in the claims. Reference should also be had to the appended claims.

What is claimed is:

1. A spring arrangement for a variable valve drive of an internal combustion engine, the spring arrangement comprising:

an intermediate lever comprising, a contact surface arranged on the intermediate lever, at least one camshaft roller arranged on the intermediate lever, the at least one camshaft roller being configured to bear against a camshaft, and a slot roller arranged on the intermediate lever, the slot roller being configured to bear against a slotted guide;

a control shaft;

at least one control shaft roller arranged on the intermediate lever on a side of the at least one camshaft roller which faces away from the slotted guide, the at least one control shaft roller being configured to bear against the control shaft;

at least one working cam contour which is formed at an end of the intermediate lever which lies opposite the at least one camshaft roller, the at least one working cam contour being configured to act on a roller drag lever of a gas exchange valve; and at least one spring element comprising a force component on the contact surface in the direction of the camshaft and in the direction of the slotted guide, and an end leg, the at least one spring element being configured to load the at least one camshaft roller of the intermediate lever against the camshaft and the slot roller against the slotted guide, and the end leg being configured to bear in a prestressed manner against the contact surface on a side of the intermediate lever which faces away from the at least one working cam contour and the camshaft.

2. The spring arrangement as recited in claim 1, wherein, the at least one camshaft roller comprises an axis of rotation, and the contact surface is arranged on the intermediate lever on a side of the axis of rotation of the at least one camshaft roller which faces away from the at least one working cam contour so that the spring element generates a torque around the axis of rotation of the camshaft roller.

3. The spring arrangement as recited in claim 1, wherein the spring element further comprises a helix arranged on a side of the intermediate lever facing away from the camshaft and the roller drag lever.

4. The spring arrangement as recited in claim 3, wherein the spring element further comprises a helix arranged on a side of the camshaft directed to the roller drag lever.

5. The spring arrangement as recited in claim 4, wherein, the roller drag lever of the gas exchange valve comprises a drag lever roller which comprises a drag lever roller axis, and the helix is arranged so that an extension of the drag lever roller axis projects through the helix.

6. The spring arrangement as recited in claim 5, further comprising two roller drag levers assigned to the double-leg spring, wherein, the double-leg spring comprises two helixes, and the two roller drag levers assigned to the double-leg spring are arranged to be adjacent to each other axially between the two helices of the double-leg spring.

7. The spring arrangement as recited in claim 6, wherein the two helices of the double-leg spring are arranged axially between the two roller drag levers.

8. The spring arrangement as recited in claim 1, wherein, the variable valve drive comprise a bearing housing, the intermediate lever comprises two intermediate lever members which are arranged adjacent to each other, each of the two intermediate lever members comprising a protrusion which form the contact surface, and the spring element is a double-leg spring comprising an intermediate leg fasted to the bearing housing of the variable valve drive and end legs configured to bear in a prestressed manner against each protrusion of the two intermediate lever members.

* * * * *